US007712419B1

(12) United States Patent
Cheng et al.

(10) Patent No.: US 7,712,419 B1
(45) Date of Patent: May 11, 2010

(54) HAND GRENADE FUZE

(75) Inventors: Gartung Cheng, Edison, NJ (US); Neha Mehta, Succasunna, NJ (US); Emily A. Cordaro, Hopatcong, NJ (US); Gregory Papatrefon, Somerset, NJ (US); Carl Hu, Parsippany, NJ (US); Brian Fuchs, Hackettstown, NJ (US); Neelam Mehta, Bel Air, MD (US); Kathy Yang, Ledgewood, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 536 days.

(21) Appl. No.: 11/747,397

(22) Filed: May 11, 2007

Related U.S. Application Data

(60) Provisional application No. 60/747,448, filed on May 17, 2006.

(51) Int. Cl.
*F42B 27/00* (2006.01)
*F42C 15/184* (2006.01)

(52) U.S. Cl. ..... 102/487; 102/254

(58) Field of Classification Search ..... 102/487, 102/222, 254, 256
See application file for complete search history.

(56) References Cited

U.S. PATENT DOCUMENTS 5,070,788 A * 12/1991 Carisella et al. ..... 102/222
5,346,014 A * 9/1994 Ross ..... 166/297
5,445,077 A * 8/1995 Dupuy et al. ..... 102/481
6,321,654 B1 * 11/2001 Robinson ..... 102/251

* cited by examiner

*Primary Examiner*—James S Bergin
(74) *Attorney, Agent, or Firm*—John F. Moran

(57) ABSTRACT

A detonator for a hand grenade fuze comprises a detonator case; a slider that is transversely reciprocable in the detonator case from an unarmed position to an armed position, the slider including a longitudinal through-hole filled with a primary explosive; a spring that biases the slider to the unarmed position; an arming mechanism attached to the slider, the arming mechanism comprising a shape memory alloy; an explosive lead disposed below the slider; and a booster charge disposed below the explosive lead.

11 Claims, 2 Drawing Sheets

HAND GRENADE FUZE

CROSS-REFERENCE TO RELATED APPLICATIONS

This application claims the benefit under 35 USC 119(e) of U.S. provisional patent application No. 60/747,448 filed on May 17, 2006, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to hand grenades and in particular to fuzes for hand grenades.

Grenades, such as the M67 fragmentation hand grenade, are widely used in the field by the US Army and US Marine Corps. The present fuze for the M67 hand grenade does not comply with the Insensitive Munitions (IM) requirements. This problem relates to the C70 Detonator used in the fuze. The detonator contains large quantities of lead-based primary explosives (lead azide, lead styphnate) as well as RDX. These explosives initiate the grenade under many of the IM test conditions. Safety issues, in combination with the environmental compliance requirements for use of lead compounds, make the manufacture of these detonators an unattractive investment for US-based manufacturers.

A need exists for a new hand grenade fuze. The new fuze must not impact the lethality of the present design (M67), while meeting the IM safety requirements. It also should reduce the item's total life-cycle cost, and the soldiers' and environment's exposure to lead.

SUMMARY OF THE INVENTION

It is an object of the invention to provide a hand grenade fuze with improved IM performance.

It is another object of the invention to provide a hand grenade fuze that contains much less lead than existing fuzes.

One aspect of the invention is a detonator for a hand grenade fuze comprising a detonator case; a slider that is transversely reciprocable in the detonator case from an unarmed position to an armed position, the slider including a longitudinal through-hole filled with a primary explosive; a spring that biases the slider to the unarmed position; an arming mechanism attached to the slider for moving the slider to an armed position, the arming mechanism comprising a shape memory alloy; an explosive lead disposed below the slider; and a booster charge disposed below the explosive lead. The arming mechanism may comprise a pull strip or rod that shrinks when heated.

Another aspect of the invention is a grenade fuze comprising the inventive detonator and a delay mix disposed above the slider.

A further aspect of the invention is a grenade comprising the inventive grenade fuze.

Yet another aspect of the invention is a method of arming the inventive grenade comprising igniting the delay mix; heating the arming mechanism with heat from the delay mix; and using the arming mechanism to move the slider in-line with the explosive lead.

Still another aspect of the invention is a method comprising externally heating the grenade until the arming mechanism moves the slider in-line with the explosive lead; and further externally heating the grenade until the arming mechanism melts and the spring forces the slider out-of-line with the explosive lead.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

To produce an IM compliant detonator, the invention uses an out-of-line slider with a memory metal mechanism that acts as the arming mechanism for the fuze train. When the safety pin is pulled, the delay column is set off. Heat produced by the burning of the delay column activates the memory metal mechanism, which moves the out-of-line slider to an in-line position. The memory metal mechanism may take a variety of forms, such as strips, rods, etc.

With memory metal strips, heat produced by the delay column causes the memory metal strips to push or pull the slider to the in-line position, thereby initiating the primary explosive. The primary explosive initiates the lead explosive, which sets off the booster. In one embodiment, a memory metal restraining rod shrinks due to the heat produced from the delay column, thereby releasing the slider. The primary explosive is a greatly reduced quantity (compared to known detonators) of lead azide or a heavy-metal free compound. The invention may use the existing C70 detonator case.

Figure 2:
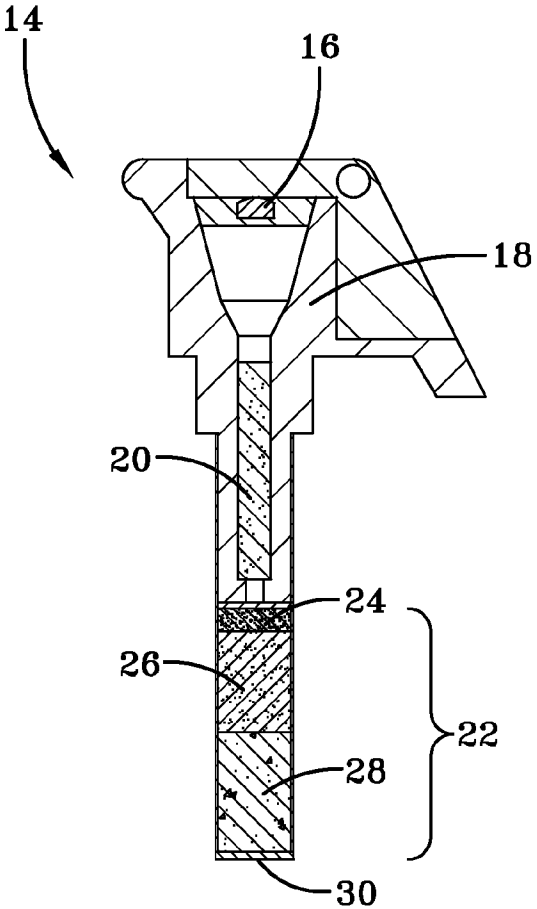
FIG-2 PRIOR ART
FIG. 2 is a sectional view of a known hand grenade fuze.
Figure 1:
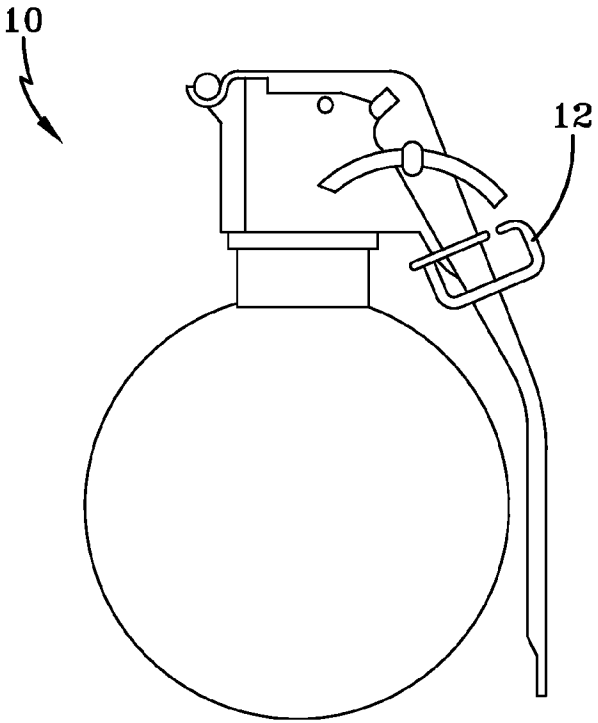
FIG-1 PRIOR ART
FIG. 1 is a side view of a known hand grenade.

FIG. 1 is a side view of a known hand grenade 10, specifically the M67 hand grenade. The M67 hand grenade is a traditional pull-pin grenade. FIG. 2 is a sectional view of the known M213 fuze 14 for the M67. Pulling the pin 12 (FIG. 1) in the fuze 14 releases the spoon and the hammer (not shown), which hits the primer 16 at the top of the fuze body 18. The primer 16 then ignites the delay mix 20. The delay mix 20 burns several seconds before initiating the attached C70 detonator 22.

The C70 detonator 22 includes a column of lead styphnate 24, lead azide 26 and RDX 28 in a detonator case 30. The detonator 22 is massive, containing approximately 10 times more lead styphnate 24, lead azide 26, and RDX 28 than other detonators. The massive size of the detonator 22 is not simply a case of over engineering. The length of the detonator 22 is required to properly initiate the grenade's explosive fill for proper fragmentation. The diameter of the detonator 22 is dictated by the dimensions of the fuze body 18.

The known fuze train is simple and has functioned well and reliably in grenades for decades. Unfortunately, the known fuze train has major safety issues. Any unwanted stimulus that causes the primer 16 to function, like fire, initiates the entire fuze train. The large quantities of primary explosive in the detonator 22 can also be detonated by external stimuli with enough energy to function the entire grenade 10. These problems are exacerbated through sympathetic detonation when many grenades are in the same location.

Figure 4B:
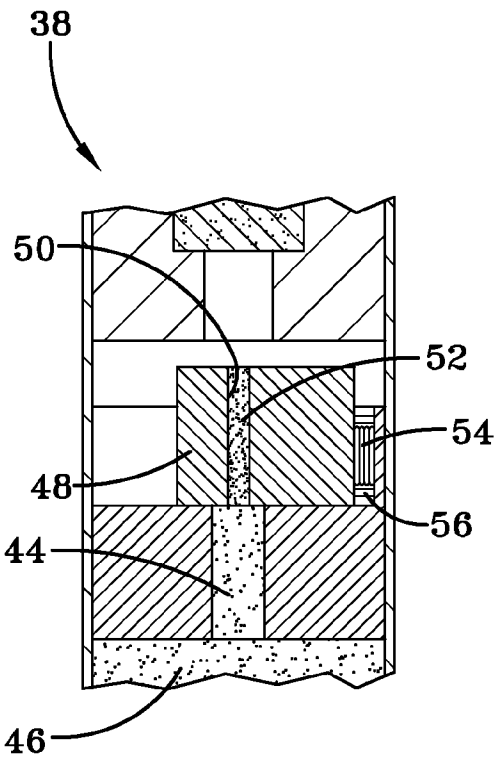
FIGS. 4A and 4B are enlarged views of a portion of FIG. 3 showing the fuze in an unarmed and armed state, respectively.
Figure 4A:
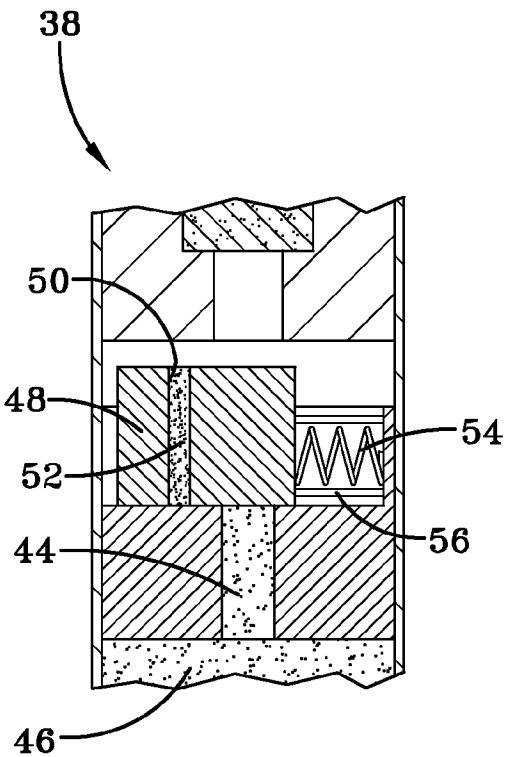
Figure 3:
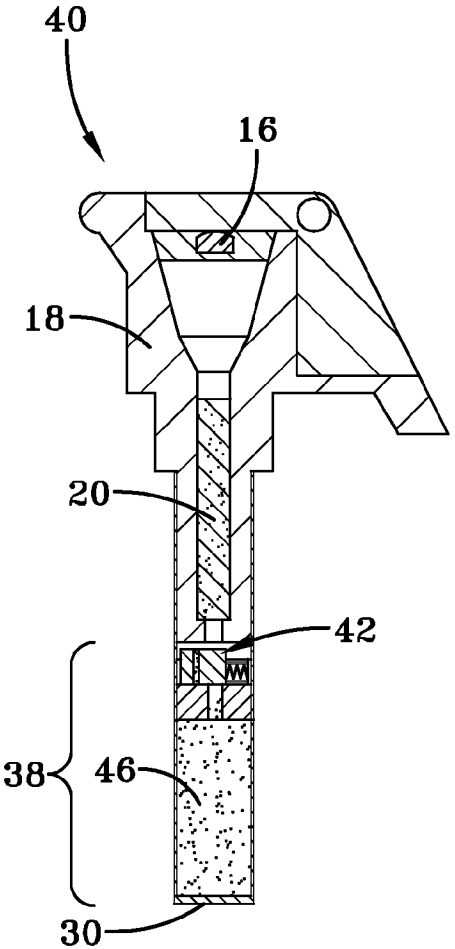
FIG. 3 is a sectional view of one embodiment of the inventive hand grenade fuze.

FIG. 3 is a sectional view of one embodiment of an inventive hand grenade fuze 40. FIGS. 4A and 4B are enlarged views of a portion of FIG. 3 showing the fuze 40 in an unarmed and armed state, respectively. Fuze 40 replaces the contents of the C70 detonator 22 with an out-of-line detonator 38 including a booster 46. The fuze 40 uses the detonator case 30 to preserve the fragmentation pattern of the grenade. While the size of the detonator case 30 is large compared to other detonators, it only has an approximate inner diameter of 0.3 inches, so extremely small interior parts are required. Detonator 38 slides the explosive 52 in line only when the delay mix 20 functions under normal conditions. Detonator 38 has drastically smaller quantities of primary explosives. Fuze 40 is expected to have improved IM performance and can use heavy metal-free primary explosives, thereby eliminating lead from the grenade.

In the embodiment of FIG. 3, detonator 38 includes a detonator case 30, a slider assembly 42, an explosive lead 44 and a booster 46. The slider assembly 42 comprises a slider 48 that is generally transversely reciprocable in detonator case 30, a spring 54 that biases the slider 48 out-of-line with the delay mix 20 and explosive lead 44, and an arming mechanism 56 made of shape memory alloy (SMA). Slider 48 has a vertical through-hole 50 filled with primary explosive 52. An explosive lead 44 and booster charge 46 may both be PBXN-5, for example.

Arming mechanism 56 may comprise one or more of pull strips, rods, or other suitable shapes. Any shape memory arming mechanism may be used as long as it responds to the heat generated by the delay mix 20 by moving the slider 48 to the in-line position. For simplicity, it is assumed that the arming mechanism 56 comprises pull strips.

In the unarmed state, FIG. 4A, the spring 54 biases the slider 48 to one side such that the primary explosive 52 is not aligned with either the delay mix 20 or the explosive lead 44. In the armed state, FIG. 4B, the pin 12 has been pulled and the primer 16 has ignited the delay mix 20. Heat from the ignition of the delay mix 20 causes the SMA pull strips 56 to shrink. The shrinkage of the SMA pull strips 56 overcomes the force of spring 54 and pulls the slider 48 to a position where the primary explosive 52 is aligned with the delay mix 20 and the explosive lead 44. The delay mix 20 sets off the primary explosive 52, which sets off the explosive lead 44, which ignites the booster 46. The booster 46 initiates the explosive fill in the grenade.

To eliminate lead from the fuze 40, a lead-free primary explosive 52 must be used in place of the lead styphnate 24 and lead azide 26. An exemplary lead-free primary explosive 52 is cyanuric triazide (referred to as triazide). Triazide is a heavy metal-free material containing three azide groups bonded to a ring of carbon and nitrogen. Tests have shown triazide to behave like a primary explosive and have demonstrated its ability to function as part of a fuze train.

One IM test involves shooting a bullet into the most sensitive portion of a munition. The most sensitive portion of the inventive fuze 40 is the primary explosive 52. If a bullet is shot into the triazide with the slider 48 in the unarmed position, FIG. 4A, the triazide is expected to ignite but neither the delay mix 20 or the explosive lead 44 should be initiated because the triazide is not in the armed position.

Another IM test is cook-off. Cook-off of a grenade with fuze 40 initially results in the pull strips 56 pulling the slider 48 into the armed position, FIG. 4B. The material comprising the pull strips 56 is selected so that the melting temperature of the strips 56 is significantly less than the initiation temperature of any of the explosives in the grenade. Therefore, as the temperature increases, the pull strips 56 will melt and fail and the spring 54 will force the slider 48 back to the unarmed position, FIG. 4A. Then, when the primary explosive 52 finally ignites, it is out of line with both the delay mix 20 and the explosive lead 44.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A detonator for a hand grenade fuze, comprising:

a detonator case;

a slider that is transversely reciprocable in the detonator case from an unarmed position to an armed position, the slider including a longitudinal through-hole filled with a primary explosive;

a spring that biases the slider to the unarmed position;

an arming mechanism attached to the slider for moving the slider to an armed position, the arming mechanism comprising a shape memory alloy;

an explosive lead disposed below the slider; and a booster charge disposed below the explosive lead.

2. The detonator of claim 1 wherein the arming mechanism comprises one of a pull strip and rod that shrinks when heated.

3. The detonator of claim 2 wherein the shape memory alloy melts at a temperature below ignition temperatures of the primary explosive, the explosive lead and the booster charge.

4. The detonator of claim 1 wherein the primary explosive comprises triazide.

5. The detonator of claim 1 wherein the explosive lead and the booster charge comprise PBXN-5.

6. A grenade fuze comprising the detonator of claim 1 and a delay mix disposed above the slider.

7. A grenade comprising the grenade fuze of claim 6.

8. A method of arming the grenade of claim 7, comprising:

igniting the delay mix;

heating the arming mechanism with heat from the delay mix; and using the arming mechanism to move the slider in-line with the explosive lead.

9. The method of claim 8 wherein the arming mechanism comprises one of a pull strip and a rod that shrink when heated to thereby move the slider in-line.

10. A method, comprising:

arming the grenade of claim 7 by externally heating the grenade until the arming mechanism moves the slider in-line with the explosive lead; and further externally heating the grenade until the arming mechanism melts and the spring forces the slider out-of-line with the explosive lead.

11. The method of claim 10 wherein the arming mechanism comprises one of a pull strip and a rod that shrink when heated to thereby move the slider in-line.

* * * * *